US009886803B2

(12) United States Patent
Oswald et al.

(10) Patent No.: US 9,886,803 B2
(45) Date of Patent: Feb. 6, 2018

(54) CRANE MONITORING SYSTEM

(71) Applicant: Manitowoc Crane Companies, LLC, Manitowoc, WI (US)

(72) Inventors: Matthew T. Oswald, Manitowoc, WI (US); Jeffrey S. Blair, Manitowoc, WI (US); James A. Alger, Shippensburg, PA (US); Brian G. Bilke, Reedsville, WI (US)

(73) Assignee: MANITOWOC CRANE COMPANIES, LLC, Manitowoc, WI (US)

( * ) Notice: Subject to any disclaimer, the term of this patent is extended or adjusted under 35 U.S.C. 154(b) by 118 days.

(21) Appl. No.: 14/399,766

(22) PCT Filed: May 9, 2013

(86) PCT No.: PCT/US2013/040345
§ 371 (c)(1),
(2) Date: Nov. 7, 2014

(87) PCT Pub. No.: WO2013/170026
PCT Pub. Date: Nov. 14, 2013

(65) Prior Publication Data

US 2015/0149026 A1 May 28, 2015

Related U.S. Application Data

(60) Provisional application No. 61/644,797, filed on May 9, 2012.

(51) Int. Cl.
*G07C 5/00* (2006.01)
*G07C 5/08* (2006.01)
(Continued)

(52) U.S. Cl.
CPC ..... *G07C 5/085* (2013.01); *B66C 13/18* (2013.01); *B66C 23/88* (2013.01); *G07C 5/0808* (2013.01); *G07C 5/0816* (2013.01)

(58) Field of Classification Search
None
See application file for complete search history.

(56) References Cited

U.S. PATENT DOCUMENTS 4,185,280 A 1/1980 Wilhelm
5,823,369 A * 10/1998 Kuromoto ..... B25J 9/1638 212/223

(Continued)

FOREIGN PATENT DOCUMENTS

EP 1286003 A1 2/2003
JP H0526184 A 2/1993

(Continued)

OTHER PUBLICATIONS

Machine Translation of KR100384637.*

(Continued)

*Primary Examiner* — James M McPherson
(74) *Attorney, Agent, or Firm* — Levenfeld Pearlstein, LLC

(57) ABSTRACT

A crane monitoring system is for determining crane service conditions is disclosed. The crane monitoring systems includes a sensor for measuring acceleration, a processing unit operably coupled to the sensor and a data store storing computer executable instructions. The computer executable instructions, when executed by the processing unit, cause the processing unit to perform a plurality of functions including determining at least one crane service condition dependent upon a signal from the sensor.

16 Claims, 10 Drawing Sheets

(51) Int. Cl.
*B66C 13/18* (2006.01)
*B66C 23/88* (2006.01)

(56) References Cited

U.S. PATENT DOCUMENTS

| | | | | |
|---|---|---|---|---|
| 5,832,730 | A * | 11/1998 | Mizui | B66C 13/066 60/469 |
| 6,496,766 | B1 | 12/2002 | Bernold et al. | |
| 7,893,826 | B2 * | 2/2011 | Stenlund | B60R 25/1004 340/517 |
| 8,866,469 | B2 * | 10/2014 | Parr | G01B 7/14 324/207.11 |
| 2009/0200256 | A1 * | 8/2009 | Vinati | B66C 13/063 212/276 |
| 2010/0095835 | A1 * | 4/2010 | Yuan | B66C 13/06 91/392 |
| 2012/0037585 | A1 | 2/2012 | Jene | |

FOREIGN PATENT DOCUMENTS

| | | | |
|---|---|---|---|
| JP | H08175787 | A | 7/1996 |
| JP | 2002-326784 | A | 11/2002 |
| JP | 2004-338815 | A | 12/2004 |
| JP | 2007-186289 | A | 7/2007 |
| JP | 2010-064880 | A | 3/2010 |
| KR | 10-0384637 | B1 | 5/2003 |

OTHER PUBLICATIONS

International Search Report and Written Opinion for International Application No. PCT/US2013/040345, dated Aug. 27, 2013 (15 pages).
Supplementary European Search Report for related EP Application No. 13787556.3, dated Nov. 4, 2015 (6 pages).
Notification of Reason for Rejection for related Japanese Application No. 2015-511703, dated Apr. 5, 2016 (12 pages).

* cited by examiner

CRANE MONITORING SYSTEM

REFERENCE TO EARLIER FILED APPLICATION

This application claims the benefit under 35 U.S.C. §119 (e) of U.S. Provisional Patent Application No. 61/644,797, filed May 9, 2012, and titled "CRANE MONITORING SYSTEM," which is incorporated, in its entirety, by this reference.

The present application relates to the field of crane service, and more particularly to systems and methods for determining the service conditions of a crane component.

BACKGROUND

Cranes have numerous components that are subject to wear as cranes age. The health of linearly extending components, such as a boom extension or outrigger extension, may be difficult to determine without physically disassembling the component. For example, wear pads are disposed internal to the linearly extending component and may not be accessible for inspection. Similarly, seals within a hydraulic cylinder and not visible with the cylinder in operation. To physically inspect these parts requires disassembly of the components which entails a stoppage of work. This inspection is typically done when the crane is not in service to avoid disruptions at the job site and is performed at predetermined intervals. Because of the difficulty is disassembling the components and the stoppage of work, the parts are typically replaced at this time, even if they still have usable life remaining.

The pre-determined interval is typically based on an amount of time, such as the age of the components or the service hours of the component. The average lifetime of the parts can be found based on past usage and a service interval can be set to ensure that the parts will be replaced before failure. Because not all parts last the average lifetime, the service interval is typically less than the average lifetime of the part. This results in the majority of the parts being replaced prior to their end of life.

It would be useful to have a system capable of determining the service condition of the components without requiring the disassembly of the component. This would enable the components to operate for longer periods of time before requiring service and would reduce the number of service parts required during the life of the crane. It would be useful for such a system to be a part of the crane itself, as well as a separate service tool for cranes not having the system.

SUMMARY

Embodiments of the invention include a crane monitoring system having a sensor, a processing unit operably coupled to the sensor, and a data store. The sensor is adapted to sense a sequence of accelerations of a linearly extending component and output a signal representative of the sequence of accelerations. The data store stores computer executable instructions that, when executed by the processing unit, cause the processing unit to perform a plurality of functions including determining at least one crane service condition utilizing a signal received from the sensor.

Embodiments further include a method for determining at least one service condition of a linearly extending crane component utilizing a service tool. A sensor is coupled to the linearly extending crane component. The sensor is adapted to sense an acceleration of the linearly extending crane component and output a signal representative of the acceleration. The linearly extending crane component is operated through a predetermined operating procedure and a signal is received at the tool from the sensor representative of a series of accelerations of the linearly extending crane component during the predetermined operating procedure. The received signal is then analyzed to determine the at least one service condition for the linearly extending crane component.

In another embodiment, a system for tracking service conditions of a fleet of cranes includes a plurality of crane sensors adapted to sense an acceleration of a crane component, a plurality of communication links operably coupled to the plurality of crane sensors, a data warehouse operably coupled to the plurality of communication links, and a processing unit operably coupled to the data warehouse. The processing unit has computer readable storage memory storing instructions that, when executed by the processing unit, cause the processing unit to analyze data previously received from the plurality of communication links to determine a baseline for determining a crane service need.

In another embodiment, a service tool for determining at least one service condition of a crane includes a housing, a first communication interface adapted to communicate with a sensor, a second communication interface adapted to communicate with a crane control system, a computer processer disposed within the housing and operably coupled to the communication interface, and computer readable storage media operably coupled to the computer processor. The computer readable storage media stores data for determining the at least one service condition and computer executable instructions. The computer executable instructions, when executed by the computer processor, cause the computer processor to implement functions including a function for receiving a signal from the sensor through the first communication link, a function for communicating with a crane control system through the second communication link, and a function for determining the at least one service condition of the crane based on the signal.

In another embodiment, a crane includes a crane body, a crane component coupled to the crane body, a sensor coupled to the crane component and adapted to sense a sequence of accelerations of the crane component and output a signal representative of the sequence of accelerations, a processing unit operably coupled to the sensor and adapted to receive the signal, and a data store storing computer executable instructions that, when executed by the processing unit, cause the processing unit to perform a plurality of functions. The functions include a function to determine at least one service condition dependent upon the signal.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

The drawings are not necessarily to scale.

DETAILED DESCRIPTION

Embodiments of the invention include systems and methods for determining the service requirements of a mobile crane. Embodiments of the present invention will now be further described in relation to the figures. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
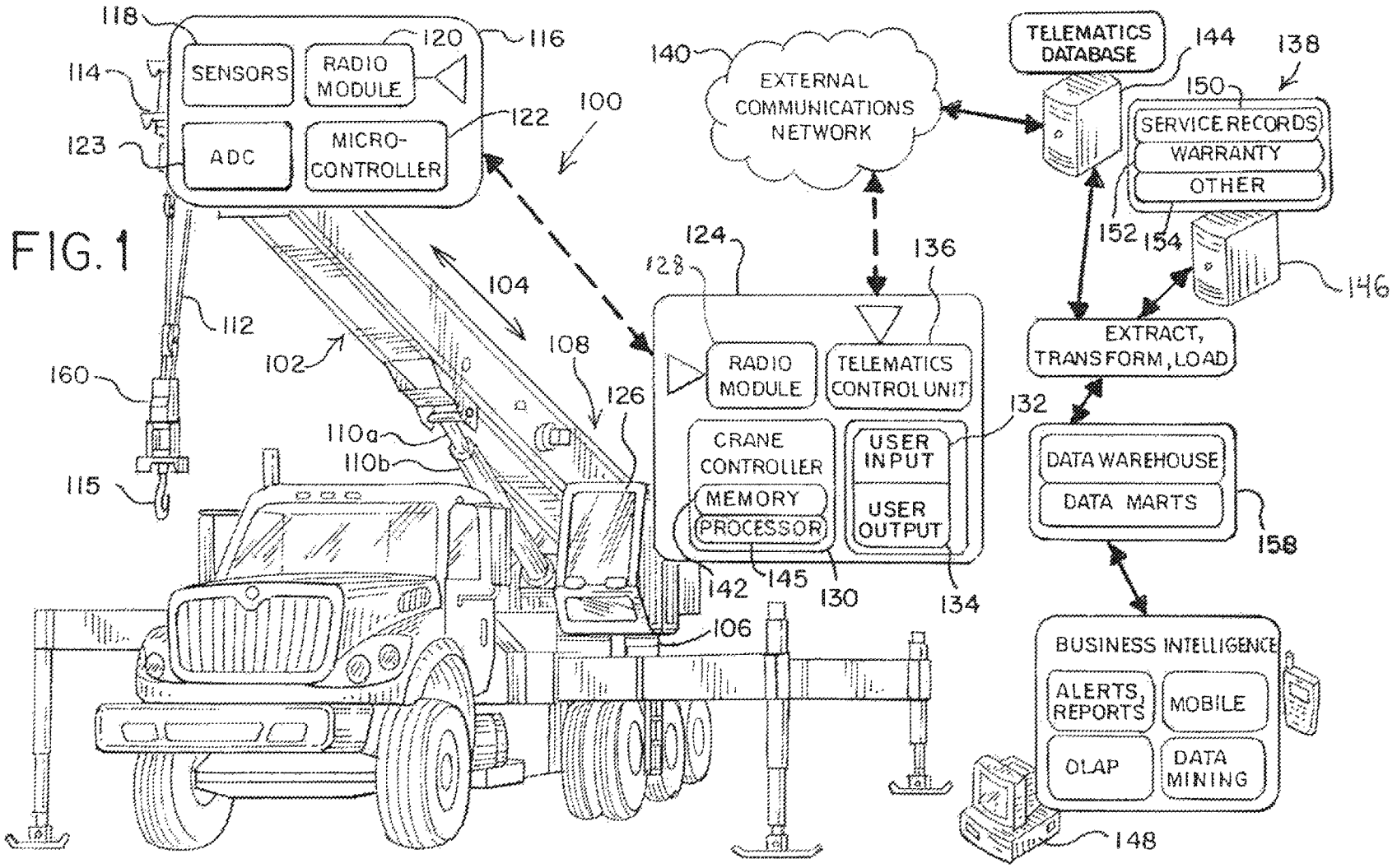
FIG. 1 is a perspective view of a mobile crane illustrating components of an embodiment of a crane service management system.

Referring to FIG. 1, an embodiment of a crane 100 is depicted. The crane 100 is comprised of a chassis 106 and a superstructure 108 coupled to the chassis 106. The superstructure 108 is adapted to rotate about the chassis 106, but in some embodiments may be fixed in a single orientation. The superstructure 108 includes a boom 102 that is designed to lift and move a load (not shown). Collectively, the chassis 106 and superstructure 108 of the crane 100 may be referred to as the crane body.

The boom 102 is connected to the superstructure 108 at a pivot that allows the boom 102 to angle up and down. A driving device, such as a hydraulic cylinder 110*b* and piston 110*a*, extends and retracts to cause the boom 102 to rotate about the pivot point, thereby angling the boom 102 up and down. Additionally, the boom 102 is designed to extend in length in a generally linear direction depicted by arrows 104. A second hydraulic cylinder and piston (not shown) is configured to cause the boom 102 to extend and retract. The boom 102 may have multiple segments such that the boom 102 can be extended in multiple steps.

A cable 112 is secured to the boom 102 and is used to couple the boom 102 to the load. The cable 112 is attached to a winding drum (not shown) disposed on the superstructure 108. The cable 112 extends from the winding drum along the boom 102 to an end 114 of the boom 102. From the end 114 of the boom 102 the cable 112 extends to a hook 115. The cable 112 may be coupled to the hook 115 through a lower sheave 160 and multiple segments of the cable 112 may support the hook 115 through a block and tackle type pulley system comprised of multiple sheaves.

The boom 102 has a number of linearly extending components associated with it that are subject to wear. Each segment of the boom 102 has at least one wear pad between it and an adjacent boom segment that reduces friction between adjacent boom segments. Each hydraulic cylinder, such as cylinder 110*b*, has an associated seal that retains the hydraulic fluid while allowing the piston, such as piston 110*a*, to translate linearly.

A sensor assembly 116 is disposed proximate a linearly extending component. The sensor assembly 116 does not need to be placed directly on the linearly extending component so long as it is able to detect acceleration from the movement of the linearly extending component. Furthermore, a single sensor assembly 116 may detect the acceleration caused by multiple component interactions; each component may have an associated sensor assembly 116; or some combination of multiple sensor assemblies may be used.

The sensor assembly 116 in the embodiment of FIG. 1 comprises sensors 118, a radio module 120, a micro-controller 122, and an analog to digital converter (ADC) 123. The sensors 118 are adapted to detect and measure accelerations. One example of a sensor particularly suited to detecting acceleration is an accelerometer and, more particularly, a multi-axis accelerometer. The ADC 123 converts an analog signal from the sensors 118 to a digital signal suitable for communication with a processing unit. The radio module 120 communicates with a second radio module 128 and delivers the digital signal from the ADC 123. The micro-controller 122 manages the sensor assembly 116.

The sensor assembly 116 may be designed to power on only when an operating condition is taking place that is relevant to a desired acceleration measurement. For example, the sensor assembly 116 may power on immediately prior to a component moving, or immediately after a component begins to move. The sensor assembly 116 may receive a signal indicating an operation is about to be performed or may detect the operation by some other means. By powering on only when a relevant operation is being performed, the battery life of the sensor assembly 116 is increased.

A crane controller assembly is 124 disposed within the superstructure 108 of the crane 100. In some embodiments, the crane controller assembly 124 may be within a cab 126 of the crane 100, or in other embodiments the crane controller assembly 124 may be located elsewhere. The crane controller assembly 124 is comprised of the second radio module 128 for communicating with the radio module 120 of the sensor assembly 116, a crane controller 130 for implementing computer executable instructions, a user input interface 132, a user output interface 134, and a telematics control unit 136.

The second radio module 128 communicates with the radio module 120 to receive sensor data. In some embodiments, the second radio module 128 may send a signal to the radio module 120 to cause the sensor assembly 116 to power on from a low power mode. The second radio module 128 communicates with the radio module 120 using any commonly available radio communication protocol, but is not limited to commonly available protocols. Other communications are possible and fall within the scope of the invention so long as a wireless communication is affected between the radio module 120 and the second radio module 128.

The telematics control unit 136 communicates with a remote computing system 138 through an external communications network 140. The external communications network 140 may include the internet, a phone network, a satellite network, or other type of network. The telematics control unit 136 sends the sensor data to the remote computing system 138 for analysis. The crane controller 130 may send all received acceleration data to the remote computing system 138 through the telematics control unit 136, or the crane controller 130 may send selective subsets of the received acceleration data. In addition to the acceleration data, the telematics control unit 136 typically sends other information to the remote computing system 138 such as an identifier, location information, crane model, or other information.

The crane controller 130 is comprised of computer readable storage memory 142 and a computer processor 145. The computer readable storage memory 142 stores instructions that when executed by the computer processor 145 cause the computer processor 145 to perform functions. The computer readable storage memory 142 may be volatile memory where the instructions are stored only when the crane controller 130 is powered on, or it may be nonvolatile where the information remains through power cycling. The computer readable storage memory 142 may further save information such as the sensor data from the sensor assembly 116, information from the telematics control unit 136, or other operating information.

A user interacts with the crane controller 130 through the user input interface 132 and the user output interface 134. The user input interface 132 and user output interface 134 may be combined in a single device such as a touchscreen, or may be separate such as a display and a keyboard. Other types of input and output are possible and one of ordinary skill in the art would recognize various user inputs and outputs that are suitable for use with embodiments of the invention. Examples of other suitable user inputs include one or more of pushbuttons, joysticks, jog dials, foot pedals, switches, touch screen, keypads, buttons, microphones, mice, track pads, and the like, and combinations thereof. Examples of other suitable user outputs include one or more of heads up displays, speakers, visual indicators, and the like, and combinations thereof.

The remote computing system 138 interacts with the crane controller 130 through the external communications network 140. The remote computing system 138 may comprise a single computer, or it may be a network of computers working together. In the embodiment shown in FIG. 1, the remote computing system 138 comprises a network of computers 144, 146, 148 working together.

A first computing system 144 is responsible for communication with the crane controller assembly 124 through the telematics control unit 136. The first computing system 144 may communicate with a large number of other crane control systems associated with other cranes that are not shown. The first computing system 144 communicates with a second computing system 146 that stores information related to a crane's history such as service records 150, warranty records 152, and other records 154. The remote computing system 138 uses the information delivered to the first computing system 144 from the crane controller assembly 124 in combination with the records of the second computing system 146 to extract, transform, and load information relevant to the service condition of the crane 100.

For example, the service record 150 and warranty record 152 may indicate that for a particular model of crane, a wear pad should be checked to determine its service condition. This information in combination with the information received from the crane controller assembly 124 at the first computing system 144 may then be used to extract information specific to that service condition. The extracted data can be used in numerous ways. In one embodiment, the extracted information can be used to determine the current service condition of the crane 100. In another embodiment, the extracted information may be saved to a data store as part of a baseline measurement for future use.

A data warehouse 158 may be part of the remote computing system 138, the first computing system 144, the second computing system 146, or some other computing system operably coupled to with the remote computing system 138. The data warehouse 158 stores information related to the service of cranes.

Figure 2:
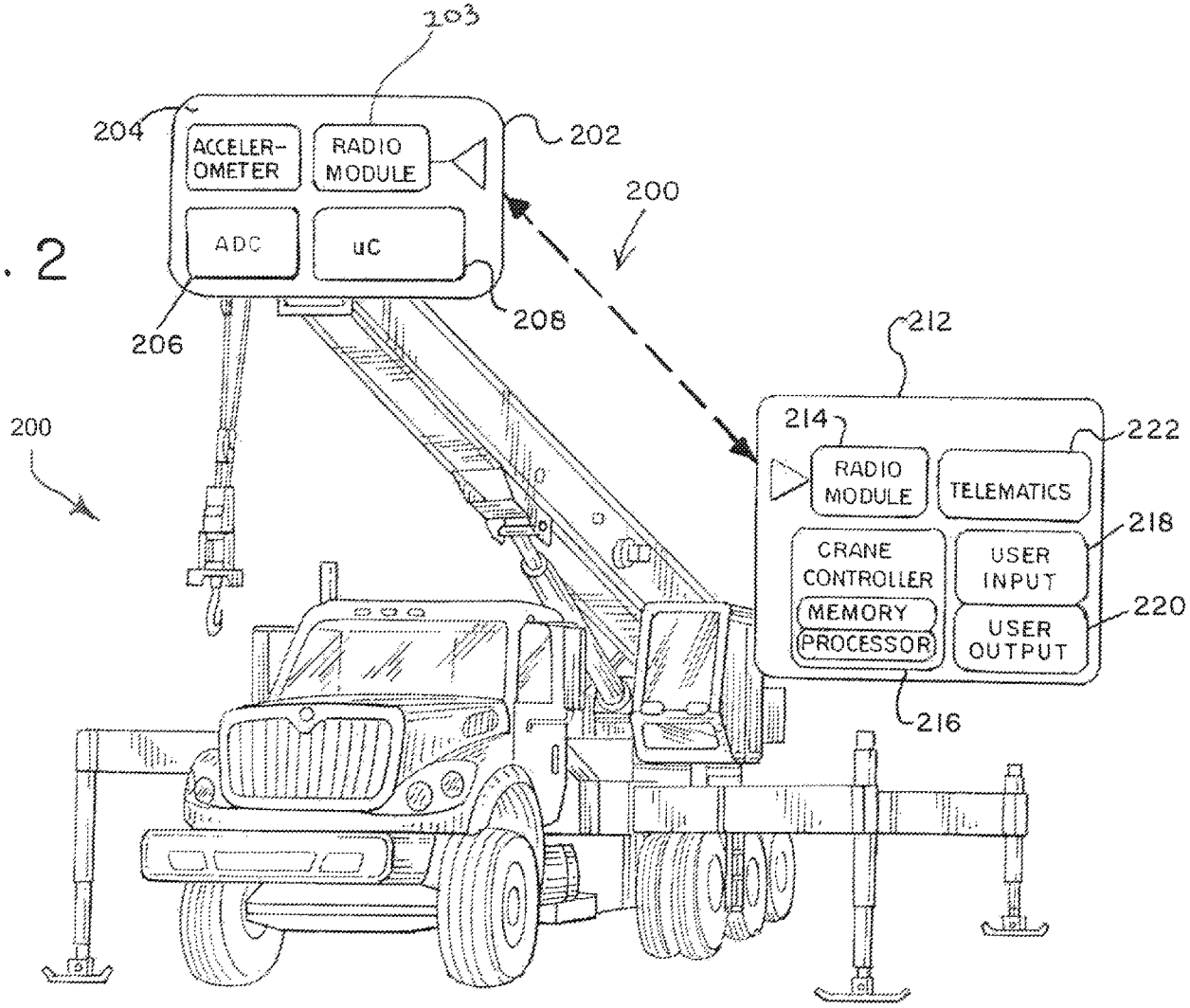
FIG. 2 is a perspective view of another mobile crane illustrating components of another embodiment of a crane service management system.

FIG. 2 illustrates a crane 200, which may be identical to the crane 100 of FIG. 1. The crane 200 includes a sensor assembly 202 and a crane controller assembly 212. Like sensor assembly 116 of the crane 100 of FIG. 1, the sensor assembly 202 includes a radio module 203, one or more sensors 204, such as an accelerometer, an analog to digital converter 206, and a micro controller 208. Similarly, the crane controller assembly 212, like the crane controller assembly 124 of FIG. 1, includes a second radio module 214 adapted to communicate with the radio module 203, a telematics unit 222, a user input 218, a user output 220, and a crane controller 216. The system shown in FIG. 2 differs from the system of FIG. 1 in part because it does not include the external communications network 140 and remote computing system 138 present in the system of FIG. 1. The crane 200 is functional without the presence of the external communications network 140 and the remote computing system 138. The crane controller assembly 212 may store information related to determining the cranes service condition in a computer readable storage medium. The crane controller assembly 212 may store the information representing the data measured by the sensor assembly 202. This information may be stored and then diagnosed by the crane controller assembly 212 for direct operator use. Alternatively, the crane controller assembly 212 may communicate with a remote computing system, such as the remote computing system 138 of FIG. 1 at pre-determined intervals or in response to an event. The information may be stored and transmitted over an external network to the remote computing system for further diagnostics.

Figure 3:
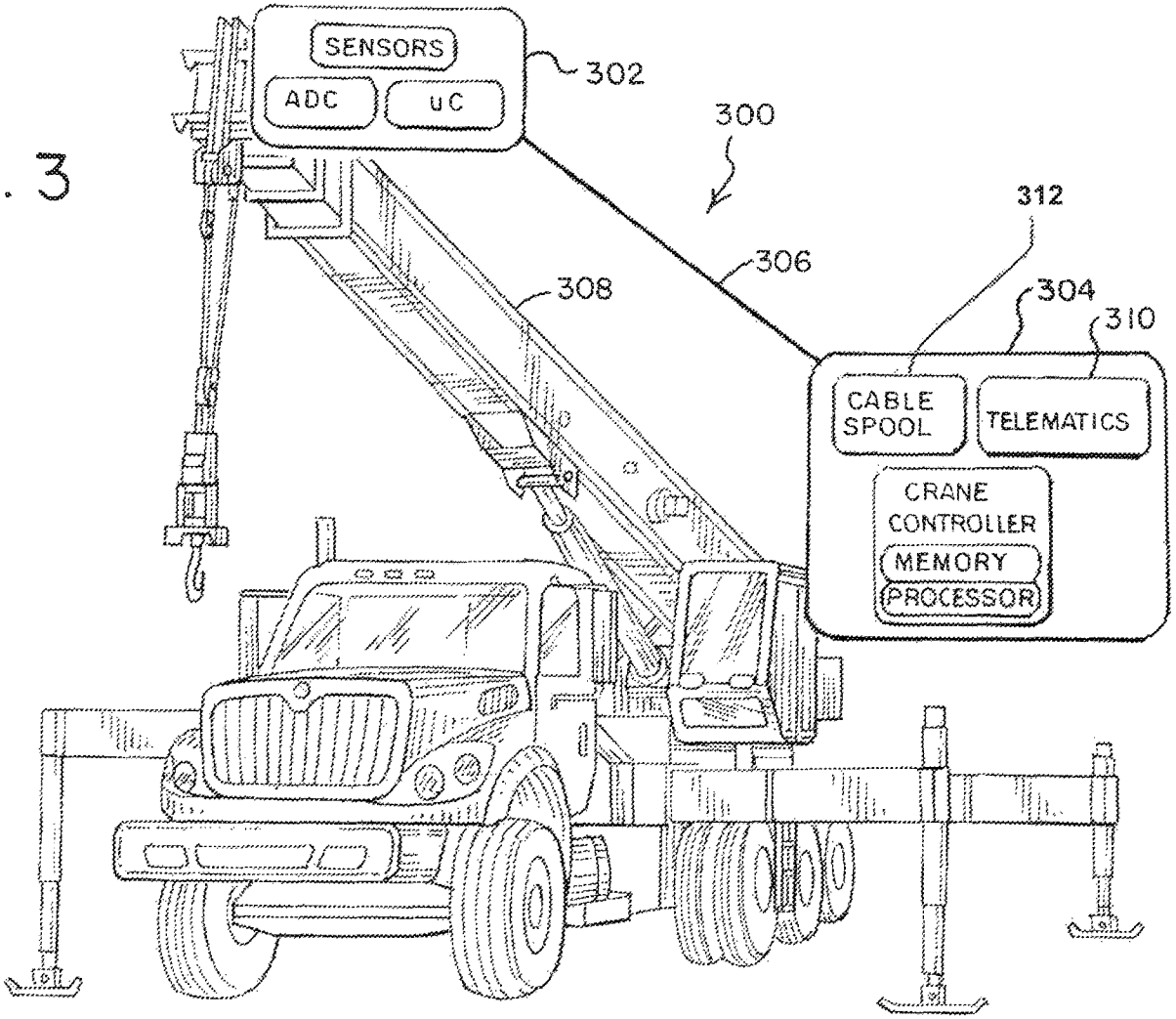
FIG. 3 is a perspective view of another mobile crane illustrating components of another embodiment of a crane service management system.

FIG. 3 illustrates an embodiment of a crane 300 in which a sensor assembly 302 is hard wired to a crane control system 304. In all other respects the embodiment of FIG. 3 functions similarly to the embodiment of FIG. 2, with the exception that the no radio module is present within the sensor assembly 302, or the crane control system 304. Instead, the sensor assembly 302 is connected directly to the crane control system 304 through a wired connection 306. In some embodiments the crane control system 304 may supply power to the sensor assembly 302 in addition to communicating with the sensor assembly 302. The wired connection 306 between the sensor assembly 302 and the crane control system may be adapted to change in length as the boom 308 extends or retracts. This length change may be effected by a spool 312 that winds the wired connector 306. The embodiment of FIG. 3 includes a telematics control unit 310 that is adapted to communicate with the remote computer system 138 of FIG. 1.

Figure 4:
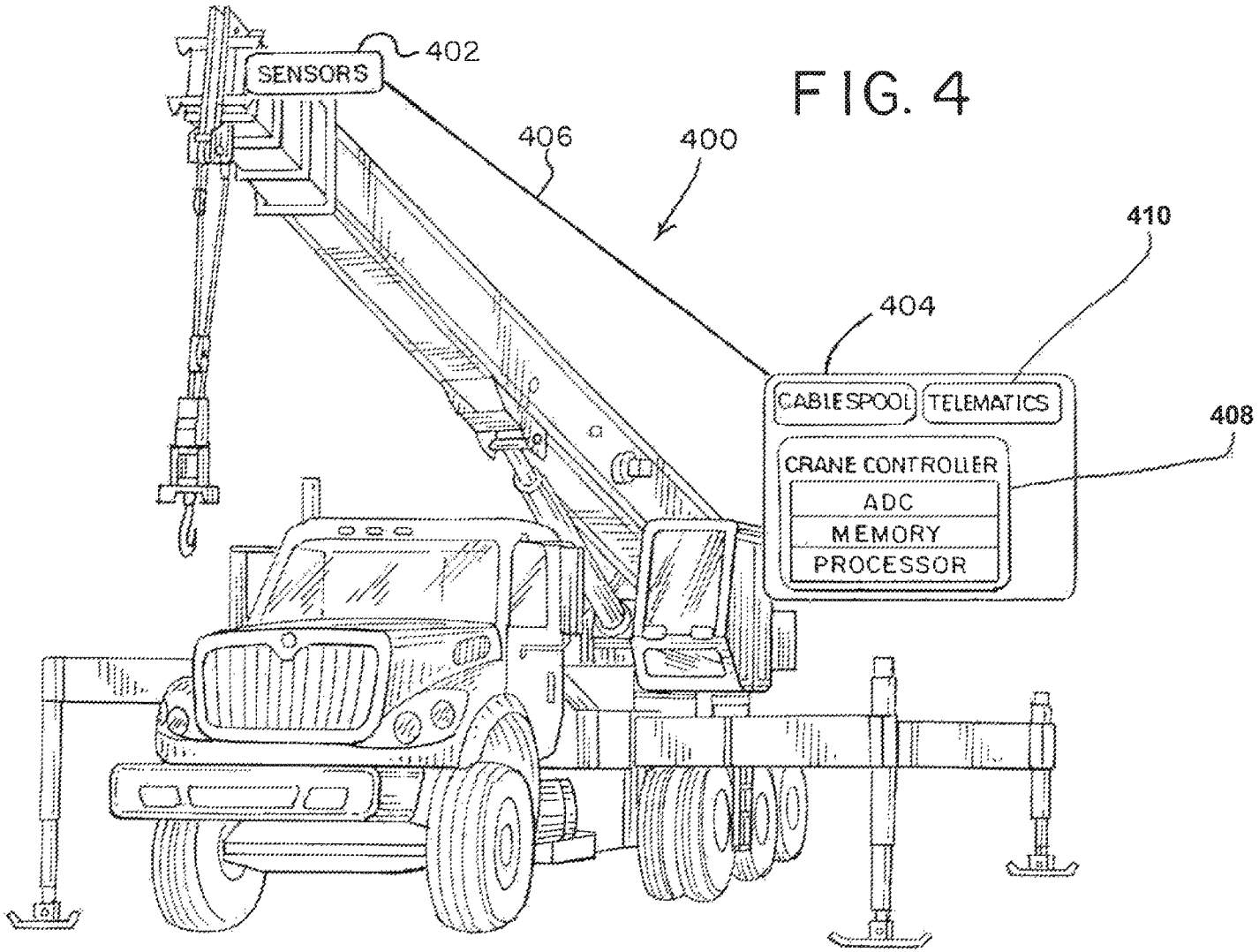
FIG. 4 is a perspective view of another mobile crane illustrating components of another embodiment of a crane service management system.

FIG. 4 illustrates an embodiment of a crane 400 in which sensors 402 communicate directly with a crane control system 404 over a wired connection 406 similar to the embodiment of FIG. 3. However, in the embodiment of FIG. 4 no microprocessor or analog to digital converter is utilized on the crane boom. Instead, the sensors 402 communicate the raw signal over the wired connection 406 to the crane control system 404. At the crane control system 404 the raw signal is processed into a digital signal by an analog to digital convertor 408. Like the embodiments of FIGS. 1 through 3, the crane control system 404 may include a telematics control unit 410 that is adapted to communicate with the remote computer system 138 of FIG. 1.

Figure 5:
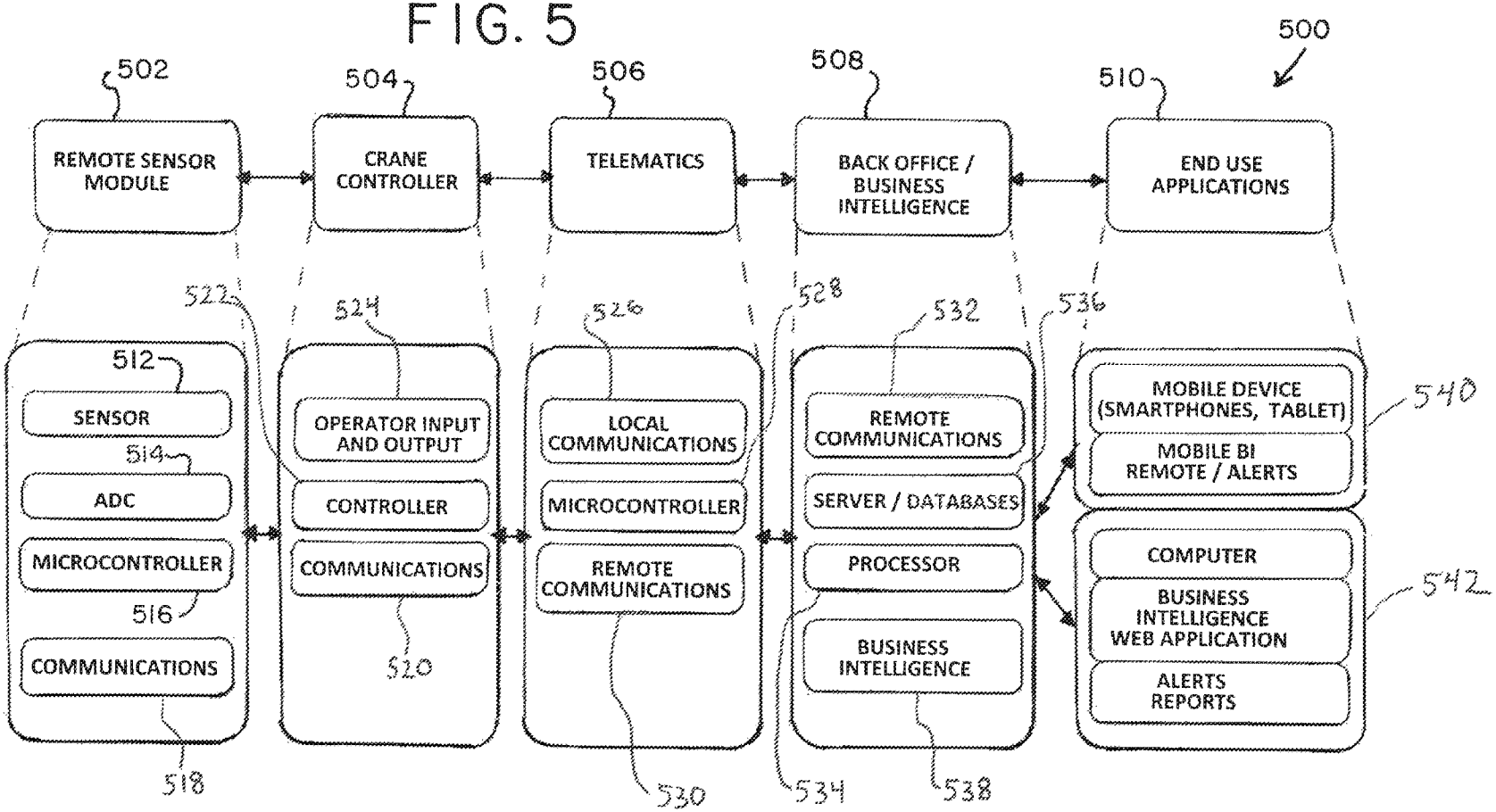
FIG. 5 is a system diagram of an embodiment of a crane service management system.

FIG. 5 illustrates a high level block diagram of an embodiment of a crane monitoring system 500. The crane monitoring system 500 is comprised of a remote sensor module 502, a crane controller 504, a telematics controller 506, a remote computing system 508 such as a back office/business intelligence system, and end use applications 510. This crane monitoring system 500 encompasses each of the previously described embodiments of mobile cranes.

The remote sensor module 502 is adapted to measure boom accelerations, noises, and other sensor modalities that can be monitored and analyzed for wear indicating patterns. For accelerations, sensors 512 such as an accelerometer or accelerometers may be rigidly attached to the boom. The sensors 512 measures boom vibration during crane operations such as telescoping and lifting. The sensor 512 produces a signal representative of the measured variables.

The signal produced by the sensor 512 is typically an analog signal which is then converted to a digital signal by an analog to digital converter 514. A microcontroller 516 manages the remote sensor module 502 and may perform tasks such as power management of the sensors, data filtering of the digital signal, and other management tasks. It is beneficial to convert the analog signal to the digital signal near the sensor 512 before the signal is attenuated or additional noise is introduced. Digital signals are less susceptible to noise and interference and can be retransmitted with no degradation. In embodiments in which the microcontroller 516 filters the data, less data may be sent to the crane controller 504. This reduces the bandwidth necessary for communications and saves power.

The remote sensor module 502 includes a communications component 518 that transmits and receives data. The communications component 518 may be powered on at all times, or may be powered on selectively by a clock, an event detector, or the microprocessor. In some embodiments the communications component 518 may be a wired connection. In such embodiments data is transmitted over the wire to the crane controller 504. The wired connection may additionally provide power to the remote sensor module 502. In other embodiments, the communication component 518 may be a wireless connection such as a Bluetooth, Wi-Fi, or other data connection. In such embodiments the remote sensor module 502 may contain its own power source such as a battery. To preserve battery power, such embodiments may power down when no measurements are taking place. The wireless connection may remain powered on in a low power state and wake in response to a signal from the crane controller 504. In other embodiments the remote sensor module 502 may receive power from a local power generator, such as the power generator disclosed in U.S. patent application Ser. No. 12/762,186 filed on Apr. 16, 2010, entitled, "Power and Control for Wireless Anti-Two Block System."

The crane controller 504 communicates with the remote sensor module 502 through a communications component 520 compatible with the communications component 518 of the remote sensor module 502. For example, if a remote sensor module 502 has a wireless communication component 518, the crane controller 504 will likewise. In some embodiments the crane controller 504 may have multiple communications components 520 such that it could communicate with both wireless communication components and wired communication components. The crane controller 504 further includes a controller 522 for implementing functions and an operator input and output 524 for interacting with a user.

The telematics controller 506 includes a local communication component 526 adapted to communicate with the communications component 520 of the crane controller 504. A remote communications component 530 is adapted to communicate with a remotes system such as the remote computing system 508. A microcontroller 528 may control the operation of the local communications component 526 and the remote communications component 530.

The remote computing system 508 is comprised of a remote communications component 532 adapted to communicate with a remote system such as the crane controller 504 by way of the remote communication component 530. A processor 534 implements computer executable instructions that may include instruction for determining the service conditions of a crane. The processor 534 is operably coupled to a database 536 that may store information related to service conditions for one or more cranes. A business intelligence unit 538 may be operably connected to the database 536 and be configured to make decisions about crane service conditions based on information contained in the database 536. Each of the components of the remote computing system 508 may be implemented individually on a single computing device or application, may be implemented as a system of computing devices or applications, or may be implemented together with one or more other component of the remote computing system.

End use applications 510 are operably coupled to the remote computing system 508 and may include mobile devices 540 configured to access information stored in the database 536 and/or access business intelligence decisions from the business intelligence unit 538. End use applications 510 may also include an end user computer 542 configured to access information stored in the database 536 and/or access business intelligence decisions from the business intelligence unit 538. The end use application 510 may be implemented on many different mobile devices, computers, web based applications, and combinations of the same.

Figure 6:
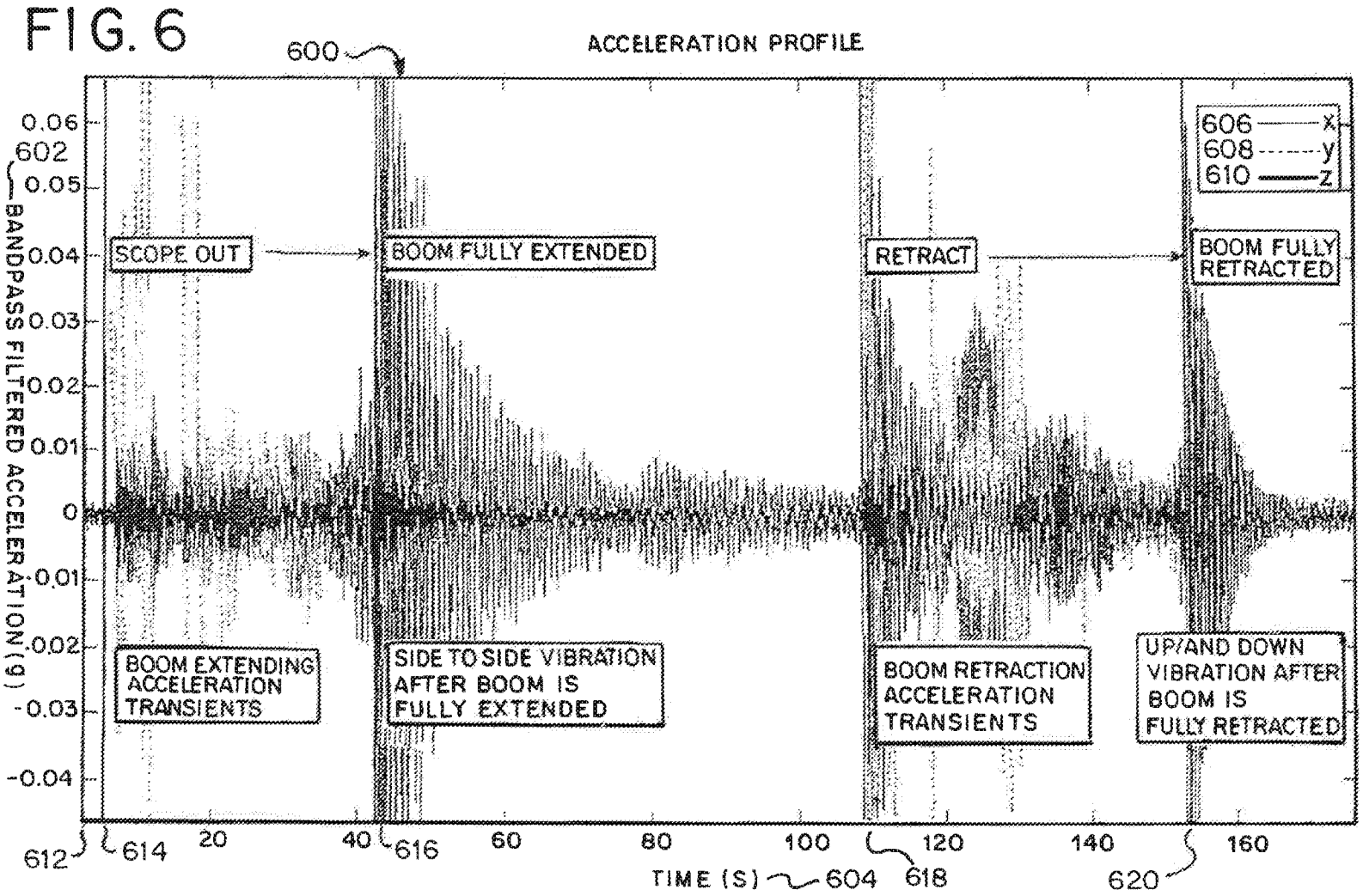
FIG. 6 is a chart illustrating acceleration measurements of a linearly extending crane component.

FIG. 6 is a chart 600 illustrating accelerations measured during a crane operation. The chart 600 will be described with relation to the crane 100 of FIG. 1. The vertical axis 602 of the chart 600 represents accelerations as measured by a 3-axis accelerometer 118 located on the boom end 114 of the crane 100. The horizontal axis 604 represents time. The accelerations have been filtered using a band pass filter so that only accelerations within a pass band of frequencies are shown. A typical pass band would include frequencies from 0.5 Hertz to 5.0 Hertz, although other ranges are feasible.

The chart 600 has three different plots corresponding to each of the three different axis of the 3-axis accelerometer 118. The first plot line 606 represents lateral or side to side accelerations of the boom end 114. The second plot 608 represents longitudinal accelerations of the boom end 114. The third plot 610 represents perpendicular accelerations at the boom end 114 that are perpendicular to the lateral and longitudinal axes.

Initially, at time zero 612, the measured accelerations are small. At time 614 the crane operator begins a predetermined crane operation. In the example of chart 600, the predetermined crane operation is telescoping the boom 102 out and back in, however other operations are feasible. As can be seen by the second plot line 608, the boom 102 experiences accelerations primarily in the longitudinal direction as the boom 102 extends. At time 616 the boom 102 has been fully extended. The longitudinal accelerations are now small in comparison to lateral accelerations, which decrease as time passes. At time 618 the operator retracts the boom 102. Transient accelerations similar to those present when the boom 102 is extended are present in the longitudinal axis. Additionally, the lateral accelerations are significantly greater than when the boom 102 is extended. At time 620 the boom is fully retracted. Once the boom 102 is fully retracted, the primary accelerations occur in the perpendicular axis and decrease as time passes.

The data comprising the chart 600 of FIG. 6 may be used to determine the service conditions of the boom 102 and or verify and improve its design. The crane service condition may be determined using the crane controller assembly 124 or it may be determined by the remote computing system 138. Examples of a processor determining crane service conditions include a processor comparing the data with historical data to determine any abnormalities. For example, the amount of time required for the longitudinal accelerations to stop could be compared against a determined normal value. If the amount of time was greater than the normal value, it may indicate that a wear pad of the boom 102 is worn, allowing excessive vibration. In another example, the longitudinal acceleration transients while retracting or extending could be greater than a baseline value, indicating a problem with the hydraulic seal of the extension mechanism. Other techniques for determining wear are possible and do not necessarily require comparing a value against a baseline. In some embodiments, wear may be determined using a combination of measurements or historical trends. The measured accelerations and calculated service conditions could be compared to historical and theoretical data to verify and improve designs.

In some embodiments, the data may be decomposed into frequency content. This may be done using a fast Fourier transform. The frequency data can then be evaluated to determine unusual frequencies or amplitudes which may indicate a service condition. Historical data obtained from similar cranes may be used to determine frequencies and amplitudes indicating particular service conditions. For example, the remote computing system 508 may have historical records of cranes in need of service. These historical records can be analyzed to determine common frequencies and amplitudes not present in normally operating cranes. Then the processing unit can be instructed to look for these conditions.

Figure 7A:
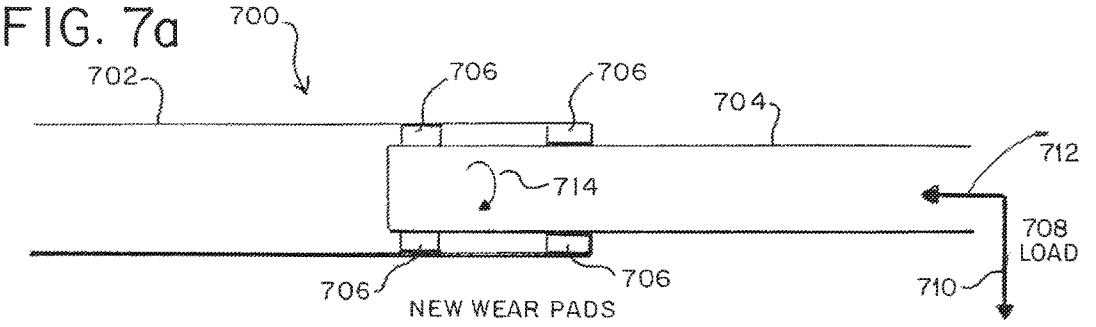
FIG. 7*a* is an illustration of a crane boom having new wear pads.
Figure 7B:
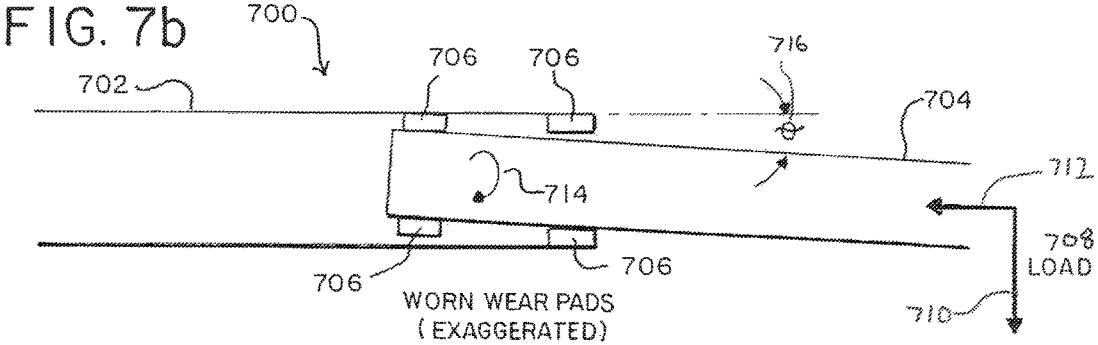
FIG. 7*b* is an illustration of a crane boom having worn wear pads.

The sensor 118 may also be used to measure an angle relative to gravity. FIG. 7*a* and FIG. 7*b* illustrate a simplified view of a boom 700. The boom is comprised of a stationary arm 702 and an extending arm 704. The extending arm 704 is supported within the stationary arm 702 by wear pads 706. A load 708 at the end of the extending arm has a normal component 710 and a tangential 712 component. The load 708 is the result of gravitational acceleration, but may also include other forces such as wind loads. The normal component 710 causes a moment 714 in the boom 700.

In a boom 700 having new wear pads 706, the moment 714 causes little orthogonal displacement of the extending arm 704 as shown in FIG. 7*a*. If the wear pads 706 are worn, as shown in FIG. 7*b*, the moment 714 results in the extending arm displacing at a displacement angle 716. An arm angle at the end of the boom 700 can be determined using the accelerometer 118. The accelerometer 118 measures the direction of gravitational acceleration, which can be broken into a tangential component and a normal component. The arm angle is equal to the inverse tangent of the ratio of the tangential component of the gravitational acceleration and the normal component of the gravitational acceleration. The displacement angle 716 can be found by calculating the difference in the arm angle with the extending arm retracted and the arm angle with the extending arm extended. Furthermore, the orthogonal displacement distance can be calculated from the boom length and displacement angle using trigonometry.

Figure 8:
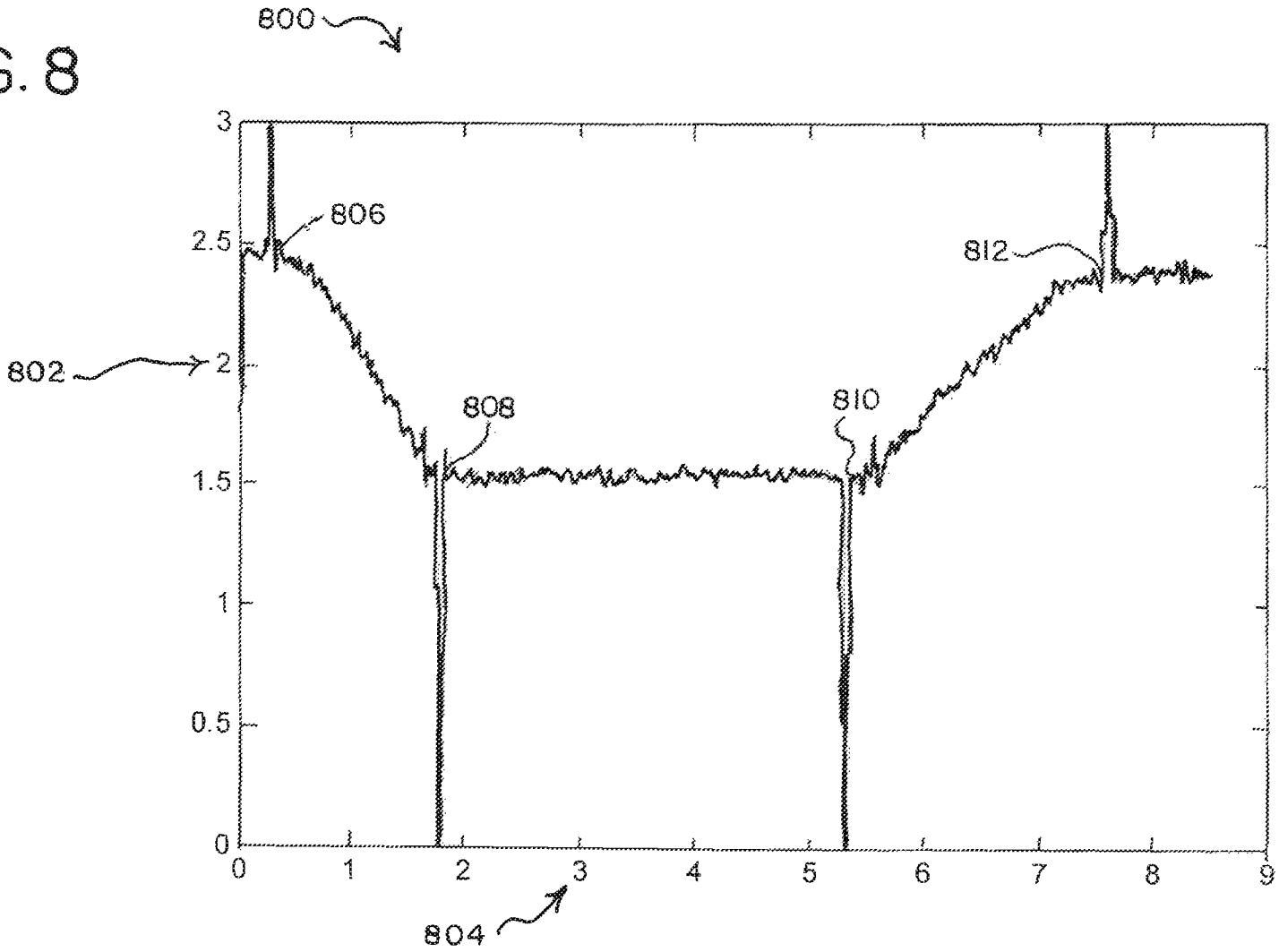
FIG. 8 is a chart of a crane boom deflection angle plotted over time.

FIG. 8 is a chart 800 of the arm angle 802 calculated from inverse tangent of the ratio of the tangential component of the gravitational acceleration to the normal component of the gravitational acceleration of an accelerometer placed on the extending arm 704 versus time 804. At point 806 the extending arm 704 is retracted and has an arm angle of about 2.5 degrees. As the extending arm 704 extends towards point 808, the arm angle decreases to about 1.5 degrees. A spike near point 806 is the result of the arm accelerating as it extends and the spike reflects measurement noise, not an actual arm angle 802. Similarly, spikes near points 808, 810, and 812 are the result of the extending arm accelerating and are not indicative of the actual arm angle 802. The extending arm 704 is held at a constant length between points 808 and 810. As such, the arm angle 802 remains relatively constant between point 808 and point 810. At point 810, the extended arm is retracted. After point 810, the arm angle 802 gradually increases until the extending arm 704 is fully retracted at point 812. During this process, the arm angle of the stationary arm is held constant.

The service condition of the linearly extending arm component can be determined by monitoring the displacement of the extending arm. The amount of displacement may be increased by having a known load on the extending arm. Like the frequency data, the displacement data may be stored, transmitted, used to determine a baseline, and used to determine service conditions.

The acceleration sensors may also be used to calculate the velocity of the boom as it extends. The velocity may be found by integrating the acceleration along the boom. A change in velocity could indicate wear in a component such as pumps, seals, and actuators. The velocity component may additionally be used to weight the accelerations measurements. For example, higher accelerations are likely if the boom is fully extended to a hard stop at a high velocity, since more kinetic energy is dissipated in stopping. The velocity can be further integrated to calculate the extension of the boom. In some embodiments, an accurate, response length sensor may be used to calculate the velocity and acceleration at the boom end.

Another useful characteristic for detecting service conditions is to measure the horizontal displacement of the boom end. Horizontal displacement of the boom end may be indicative of wear and, upon exceeding a threshold, may be used to trigger a service condition such as a need for preventative maintenance. The horizontal displacement may be found by twice integrating the horizontal accelerations.

The crane controller 504 may receive baseline data from the database 536, or it may calculate its own baseline data based on past measurements. The baseline data is stored in memory and used to compare the baseline to the measured data.

The data may be transmitted to the remote computing system 508 over the external communications network. The data may be transmitted immediately, or it may be stored in memory and transmitted at a later time. The crane controller 504 may determine the service of the crane using the data and a baseline previously stored in memory. In some embodiments the baseline may be retrieved over the external communications network for use by the crane controller 504. In still other embodiments, the remote computing system 508 may make the determination of crane service condition using the data transmitted by the crane controller 504. In such embodiments the remote computer system 508 may then send a status identifier indicating at least one crane service condition back to the crane control system. The remote computing system 508 may also send an updated baseline to the crane controller 504 for future use.

The crane controller 504 may prompt a crane operator to operate the crane through a known crane operation. For instance, the crane controller 504 may prompt the operator to angle the boom at a 45 degree angle and extend the boom, hold the extension for a minute, and then retract the boom. Having the crane operator perform a known crane procedure allows for simpler identification of crane service conditions. The crane controller 504 may record the operators input, verifying that the operator performed the known operation.

In some embodiments the crane may include at least one additional sensor adapted to communicate with the crane controller 504. The at least one additional sensor may sense an additional crane state such as the boom length, a crane load, a boom position, or a boom angle. This information may be stored by the crane controller 504 and may be used to verify that the crane performed the known crane operation. The information may also be used in conjunction with the sensor data to verify the service condition of the crane.

Figure 9:
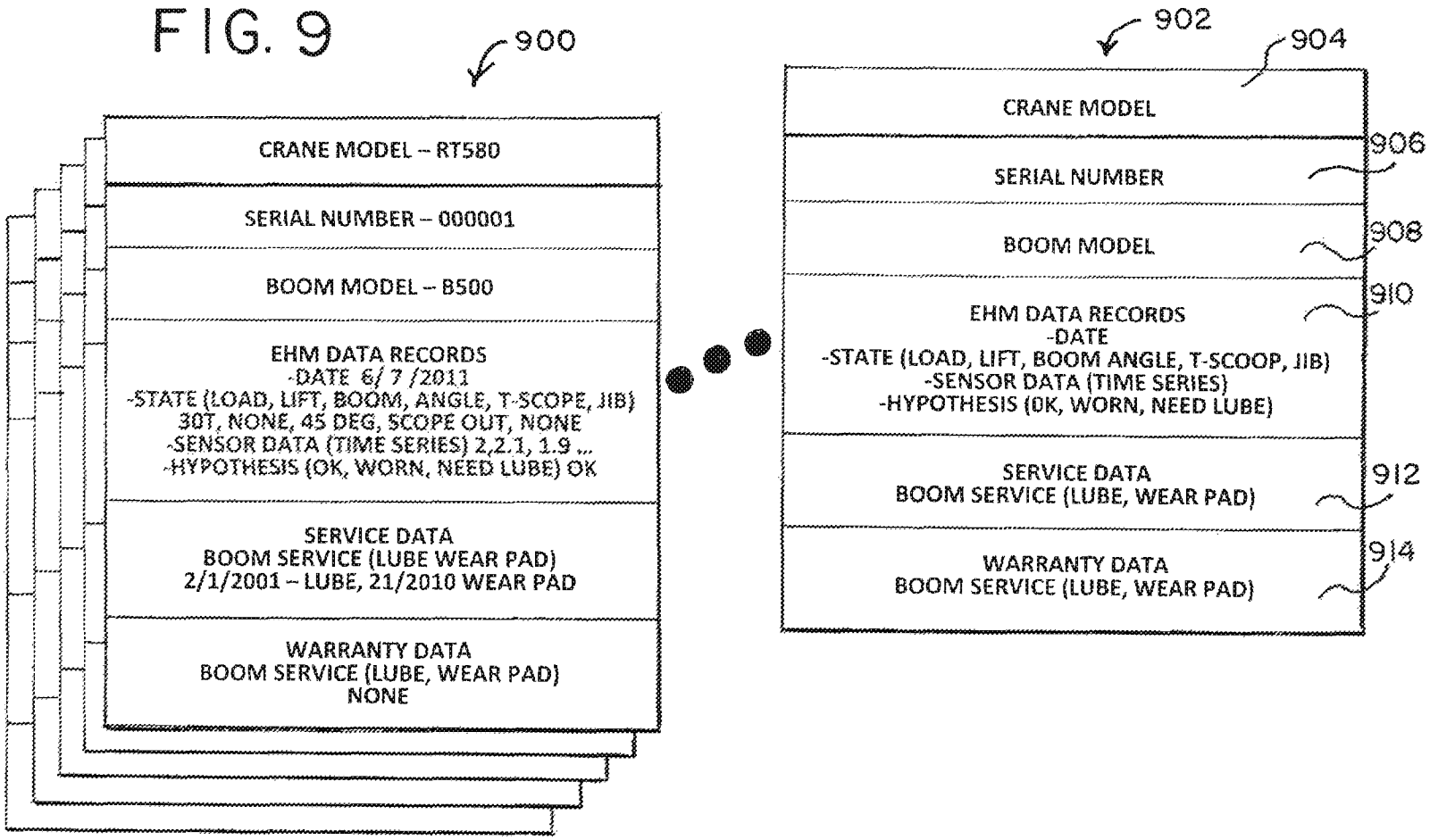
FIG. 9 is an illustration of a crane service database and a blank record of the database.

When the crane controller 504 sends the data to the remote computing system 508, it may include other data such as a crane identifier, a time, a location, ambient conditions, and other data. The remote computing system 508 stores the data in a service database. One example of the service database is shown in FIG. 9. In FIG. 9 the database 900 is comprised of a plurality of service records 902. Each service record 902 stores the crane model 904, serial number 906, boom model 908, data record 910, service data 912, and warranty data 914. This list of data fields is illustrative and embodiments are not limited to this example.

The remote computing system 508 may use the information contained in the database 900 to determine service conditions for the crane based on the data received from the crane. For example, the crane may send data representing the accelerations measured at the boom, along with the crane serial number. Other data may be sent including information such as the linear extending component extension length and displacement angle as previously described. The remote computing system 508 may then find all prior records of the crane based on the serial number and compare past acceleration data, or other data, to the received data. Or, the remote computing system 508 may develop a baseline for that particular model of crane based on the data records of plurality cranes of that model. In some embodiments the baseline may be calculated prior to receiving the data from the crane. The baseline may be stored in the data record for the crane on the crane controller 504.

In some embodiments, a service warning could be triggered from a weighted sum of an occurrence of events detected by the sensor. For instance, in one example a check could be triggered by a formula such as (number of type 1 events)/N1+(number of type 2 events)/N2+(number of type 3 events)/N3>=1 where N1, N2, and N3 are weighting factors and N1>N2>N3. (I.E. 10 type 1 events, 1,000 type 2 events, or 100,000 type 3 events or a sufficiently weighted combination trips the warning check.) The events may be differing thresholds of a single type of event. For example, a vibration may have three different thresholds with the lowest threshold corresponding to a minor event and the highest threshold corresponding to a major event. In such a system a lot of minor vibrations would be allowable before a service warning was activated, or relatively few major vibrations would result in a service warning. For example, a minor vibration may be associated with a normally worn wear pad, while a major vibration may be associated with a failed wear pad. The actual storage and calculating of the data can be performed at the crane controller 504, or the events may be sent to the remote computing system 508 for calculating.

Many preventative maintenance schedules are based simply on calendar time. Others try to use data more indicative of expected wear, such as by logging the number of hours an engine is running. The present invention can be used to keep track of actual usage of a given crane component, such as the actual usage of the components that can wear during extension and retraction of a telescopic boom. In such an embodiment, a measured metric could be the weighted distance traveled. For example the sum of extension and or retract cycles under load conditions can be calculated. The sensor 512 would be able to detect the actuation of the linearly extending component and could determine the distance traveled. The crane controller 504 typically has a sensor 512 measuring the load on linearly extending component. A metric might be (number of type 1 loads retracted)/N1R+(number of type 1 loads extended)/N1E+(number of type 2 loads retracted)/N2R+(number of type 2 loads extended)/N2E+(number of type 3 loads extended)/N3R+(number of type 3 loads extended)/N3E where N1R, N1E, N2R, N2R, N3E, and N3R are weighing factors and N1E>N2E>N3E and N1R>N2R>N3R. For example a type 1 load could be a load of at least 67% capacity, and a type 2 load could range from 33% to 66% of capacity. The number of loads could be fractional if the linearly extending component did not complete an extension or retraction. The sensor 512 may also be used to determine the actual distance traveled and use that measurement. Again the actual storage and calculating of the data can be performed at the crane controller 504, or the events may be sent to the remote computing system 508 for calculating. These metrics would prove an accurate indication of expected wear on parts that would then be replaced in a preventative maintenance procedure.

Figure 10:
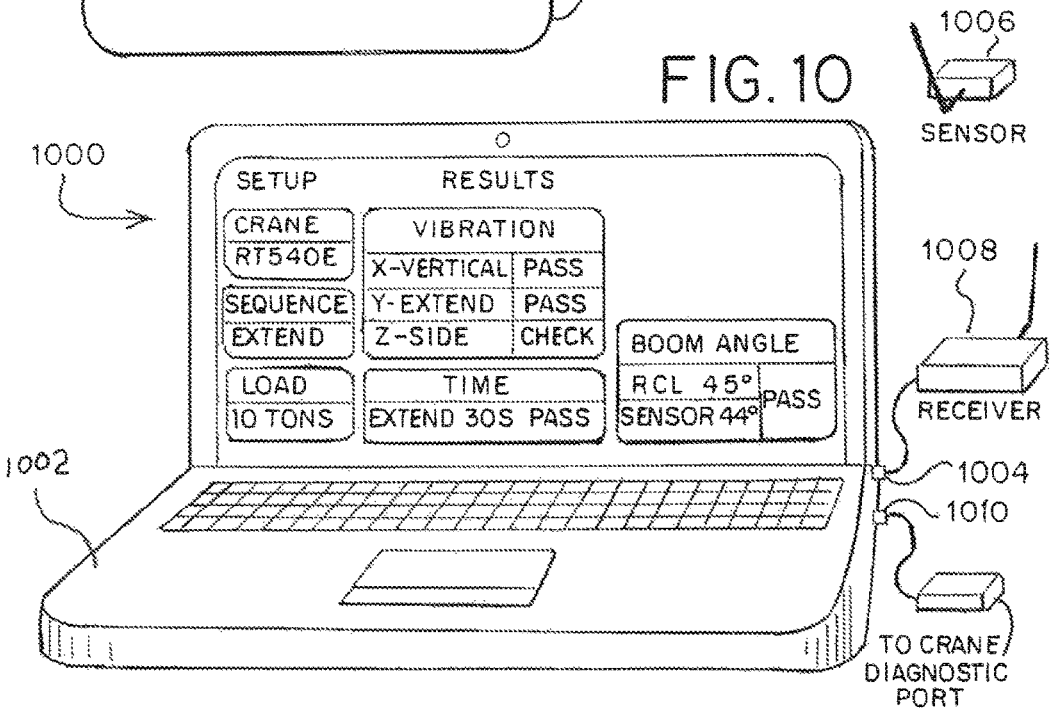
FIG. 10 is an illustration of a service tool for determining service conditions of a crane.

In the embodiment of FIG. 10 a service tool 1000 is depicted. The service tool 1000 has a housing 1002 that is portable. Within the housing 1002 the service tool contains a first communication interface 1004 adapted to communicate with a sensor 1006, such as an accelerometer. The first communication interface 1004 may have an external wireless receiver 1008 adapted to communication with the sensor 1006. A second communication interface 1010 is adapted to communicate with a crane control system. The first communication interface 1004 and the second communication interface 1010 may be wired or wireless, or a combination of the two. The communication interfaces 1004, 1010 may use different communication protocols.

A computer processor is operably coupled to the first communication interface 1004 and the second communication interface 1010 such that the computer processor is able to communicate with the first communication interface 1004 and the second communication interface 1010. A computer readable storage media is operably coupled to the computer processor. Examples of computer readable storage media include hard disk, flash drive, optical disks, tape drives, or any other media that stores computer readable data. The computer readable storage media stores computer executable instructions, that, when executed by a computer processor, cause the computer processor to implement functions. Such functions include a function for receiving a signal from the sensor 1006 through the first communication interface 1004, a function for communication with the crane control system through second communication interface 1010, and a function for determining at least one service condition of the crane based on a received signal.

The computer readable storage media also stores data for determining the service conditions of the crane. The data for determining the cranes service condition may include data related to a plurality of crane models and the functions implemented by the computer processor may further include a function for selecting data relating to a given crane model from the plurality of crane models. In some embodiments the functions may include a function for detecting a crane model from the plurality of crane models. For example, the service tool may have a Radio Frequency Identification Data (RFID) tag scanner operably coupled to the computer processor through a communication interface, or a bar code scanner operably coupled to the computer processor through a communication interface. The crane or crane components may have an RFID tag or a barcode that identifies the crane or crane component to the service tool.

In another embodiment the service tool 1000 includes a third communication interface adapted to communicate with a remote data warehouse such as the remote computing system 508 of FIG. 5. The functions of the service tool 1000 may include a function for sending data representative of the received sensor signal through the third interface to the data warehouse and a function for receiving update data for updating the data for determining a crane's service condition. In some embodiments the service tool 1000 may receive an indication of the cranes service condition from the remote data warehouse over the third communication interface. The data for determining the service conditions of the crane may comprise the indication of the crane's service condition received from the remote data warehouse.

In some embodiments the service tool 1000 includes a sensor 1006, such as an accelerometer. The sensor 1006 is configured to couple to a crane component and to communicate with the computer processor over the first communications interface 1004. The housing 1002 may have a holder sized and shaped to receive the sensor 1006. In such embodiments the sensor 1006 is stored in the holder and can be removed to couple the service tool 1000 to a crane component.

Figure 11:
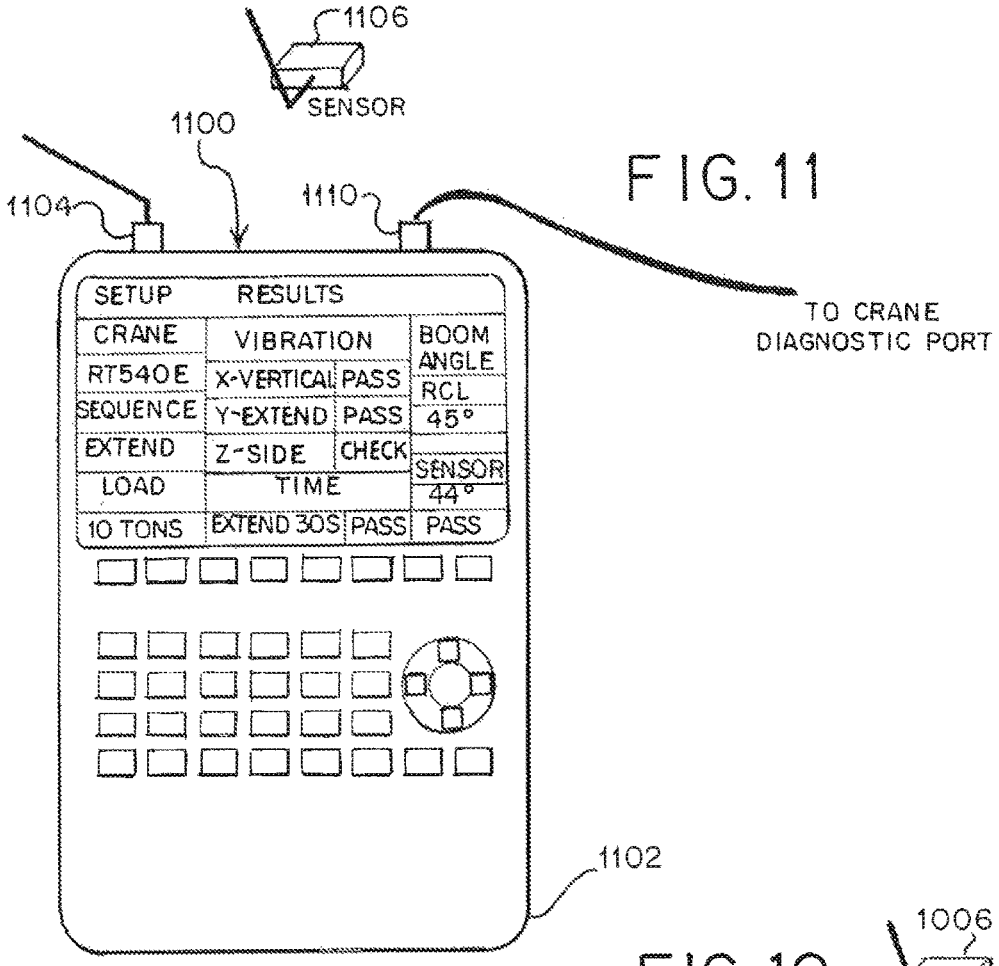
FIG. 11 is a second illustration of a service tool for determining service conditions of a crane.

FIG. 11 illustrates another embodiment of a service tool 1100. Service tool 1100 is similar to the service tool of FIG. 10 and includes a housing 1102 having a processor, computer readable storage media, a first communication interface 1104, and a second communication interface 1110. However, the first communication interface 1104 of service tool 1100 is a wireless interface whereas the first communication interface 1004 of service tool 1000 is a wired connection communicatively coupled to a wireless receiver 1008. The first communication interface 1104 communicates with a sensor 1106 using a wireless communication protocol. Second communications interface 1110 is a wired interface that communicates with the crane controller. In some embodiments the service tool 1100 may communicate with both the sensor and the crane controller over a single wireless interface. In such instances, the single wireless interface may be considered to be both the first communication interface 1004 and the second communication interface 110.

Embodiments have been described in relation to a crane boom, but are applicable to any vibrating component of a crane. For example, a lattice boom, a lattice jib, an outrigger beam, and an outrigger jack may have their service conditions determined using embodiments of the invention. In such embodiments, records within the database would contain additional fields to record the accelerations association with the component. Based on accelerations previously provided by cranes of the same model, appropriate baselines can be developed for the components.

Furthermore, other measurements may be used in conjunction with the acceleration data to determine crane service needs. For example, sensors may monitor temperature and noise for use in determining a cranes service conditions. It should be understood that various changes and modifications to the presently preferred embodiments described herein will be apparent to those skilled in the art. For example, the invention may also be used on an outrigger or hydraulic cylinder. Such changes and modifications can be made without departing from the spirit and scope of the present invention and without diminishing its intended advantages. It is therefore intended that such changes and modifications be covered by the appended claims.

What is claimed is:

1. A crane monitoring system comprising:

a crane having a linearly extending component, the linearly extending component having a first segment configured for telescoping movement relative to a second segment;

a) a sensor positioned on the crane adapted to sense a sequence of relative accelerations between the first segment and the second segment of the linearly extending component resulting from extension, retraction, or both extension and retraction, of the first segment relative to the second segment of the linearly extending component, and output a signal representative of the sequence of relative accelerations;

a processing unit operably coupled to the sensor and adapted to receive the signal;

a data store storing computer executable instructions that, when executed by the processing unit, cause the processing unit to perform a plurality of functions including:

i) a function to determine at least one crane service condition utilizing the signal.

2. The crane monitoring system of claim 1 wherein the plurality of functions further includes:

i) a function to decompose the signal into frequency content, and wherein the function to determine at least one crane service condition comprises evaluating the frequency content.

3. The crane monitoring system of claim 1 wherein the data store further stores the baseline data.

4. The crane monitoring system of claim 1 further comprising:

a) a data link operably coupled to the processing unit, the data link adapted to communicate with a remote computing system.

5. The crane monitoring system of claim 4, wherein the function to determine at least one crane service condition comprises transferring data representing the signal to the remote computing system over the data link and receiving an indication of the at least one crane service condition over the data link.

6. The crane monitoring system of claim 4 wherein the data store further stores baseline data and wherein the function to determine at least one crane service condition comprises comparing the signal to the baseline data and the plurality of functions further includes:

a) a function for sending data representing the signal to the remote computer system over the data link, and b) a function for receiving an updated baseline data from the remote computer system over the data link.

7. The crane monitoring system of claim 1 wherein the plurality of functions further comprise a function for prompting an operator to operate the crane through a predetermined crane operation.

8. The crane monitoring system of claim 1 wherein the plurality of functions further comprises a function for recording a crane operator input.

9. The crane monitoring system of claim 1 further comprising at least one additional sensor adapted to sense at least one crane state and output at least one additional signal representing the sensed at least one crane state, and wherein the processing unit is further adapted to receive the at least one additional signal, wherein the plurality of functions include storing data representing the at least one additional signal.

10. The crane monitoring system of claim 9 wherein the at least one crane state is selected from a group consisting of boom length, crane load, boom position, and boom angle.

11. The crane monitoring system of claim 9 wherein the function to determine at least one crane service condition utilizes the at least one additional signal.

12. The crane monitoring system of claim 1 wherein the plurality of functions further comprise a function to wake the sensor in response to receiving an input indicating pending actuation of the linearly extending component.

13. The crane monitoring system of claim 12 wherein the plurality of functions further comprises a function to cause the sensor to enter a low power state in response to receiving an input indicating inactivity of the linearly extending component.

14. The crane monitoring system of claim 1 wherein the sensor is a three axis accelerometer.

15. The crane monitoring system of claim 9 wherein the plurality of functions include a function for monitoring an operator input, and wherein the function to determine at least one crane service condition further utilizes operator input.

16. The crane monitoring system of claim 15 wherein the operator input is a joystick position.

* * * * *